United States Patent [19]

Verhoeven

[11] 4,363,530

[45] Dec. 14, 1982

[54] SPACER ELEMENT FOR USE IN AN ELECTRICAL CONNECTOR APPARATUS

[75] Inventor: Laurentius M. Verhoeven, Zijtaart, Netherlands

[73] Assignee: E. I. Du Pont de Nemours and Company, Wilmington, Del.

[21] Appl. No.: 221,885

[22] Filed: Dec. 31, 1980

[30] Foreign Application Priority Data

Jan. 22, 1980 [NL] Netherlands ..... 8000394

[51] Int. Cl.[3] ..... H01R 9/09; H01R 25/06

[52] U.S. Cl. ..... 339/17 C; 339/156 R; 339/176 M; 339/196 M

[58] Field of Search ..... 339/17 R, 17 C, 91 R, 339/125 R, 128, 156 R, 176 R, 176 M, 176 MP, 198 R, 198 S, 198 P, 198 H, 278 M, 196 R, 196 A, 196 M, 126 R, 126 RS

[56] References Cited

U.S. PATENT DOCUMENTS 4,173,387 11/1979 Zell ..... 339/196 M

FOREIGN PATENT DOCUMENTS 4422 10/1979 European Pat. Off. ..... 339/176 M
2340211 7/1976 Fed. Rep. of Germany .
2651345 5/1978 Fed. Rep. of Germany .
2237332 2/1975 France .

*Primary Examiner*—Neil Abrams

[57] ABSTRACT

In an electrical connector apparatus two connectors are each attached to opposite ends of a multiplicity of connector pins and the middle of said pins are mounted in a circuit board, one of said connectors being spaced apart from the circuit board by a pair of spacer elements and connected to the other connector by a pair of mounting pegs passing through openings in the circuit board and spacer elements. Movement between one connector and the circuit board is achieved in response to rotation of the spacer elements.

3 Claims, 8 Drawing Figures

Fig. 1
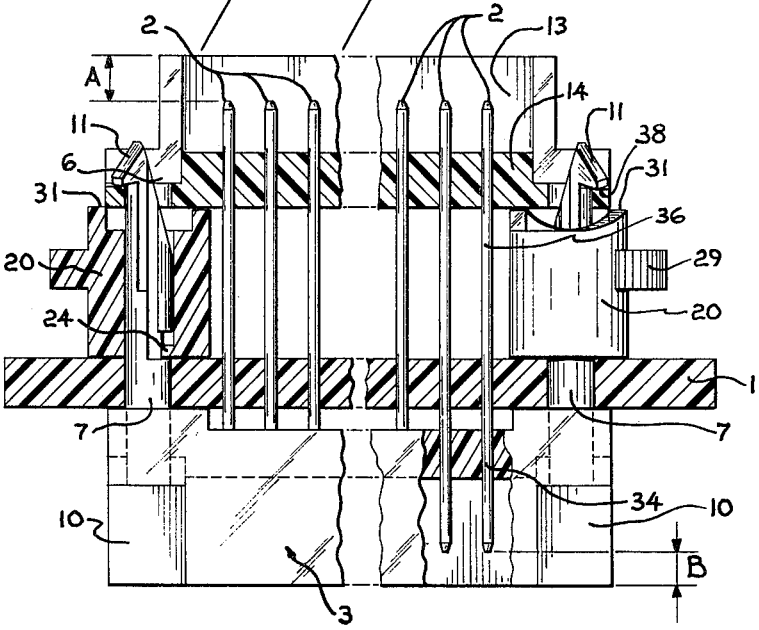
Fig. 4a
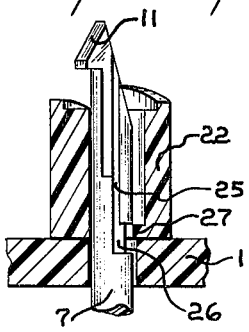
Fig. 4b
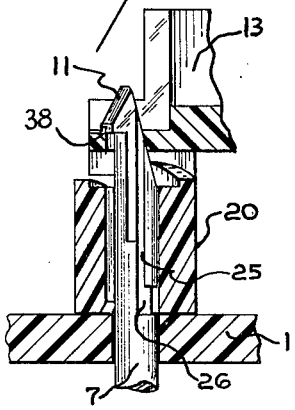
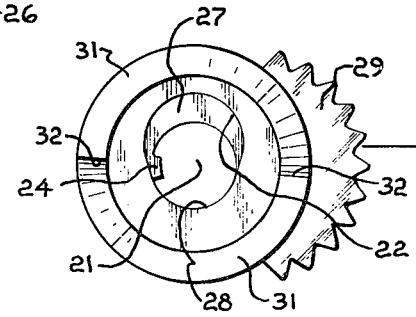
Fig. 3

SPACER ELEMENT FOR USE IN AN ELECTRICAL CONNECTOR APPARATUS

BACKGROUND OF THE INVENTION

The invention relates to an electrical connector system comprising a first connector frame adjustable to a circuit board, a number of connector pins arranged in a predetermined pattern positioned in openings in the circuit board and in openings in said first connector frame so, that parts of said pins protruding from one side of said circuit board form together with said first connector frame, a first connector. The parts of said pins protruding from the other side of said circuit board can be used for attaching connecting leads.

Such connector systems are in wide use in the electro-technical and electronics industry. Especially connecting pins with rectangular diameter are used for making connections in the so-called "wire wrap" technique. The ends of the connecting leads stripped of insulation are in a number of turns wrapped around the connecting pins. Because of the resulting mechanical deformation a good contact is produced.

It is often necessary to establish connections between a number of said connecting pins and further connectors. According to the state of the art a second combination of connecting pins is positioned in suitable openings in the circuit board and these are positioned in a second connector frame. The ends of these connecting pins protruding from one side of the circuit board are used for establishing the connections with the pins from the first group of connecting pins belonging to the first connector. This method is circuitous and requires a substantial amount of space and material.

SUMMARY OF THE INVENTION

It is an object of this invention to realize in a connector system of the above mentioned type a means of making connections between a second connector and a first connector with relatively little material and within relatively little space. In accordance with this object the second ends of pins connecting from one side of a circuit board are kept free during the attaching of the connecting leads. A second connector frame is positioned onto the second ends of the pins so, that said second connector frame together with the second ends of the pins forms a second connector. The second connector frame is mounted by means of a pair of spacer elements at a specified distance from the circuit board and is connected to the first connector frame by means of mounting pegs attached to both ends of said first connector frame and running through suitable openings in said circuit board, through said spacer elements and then to openings in the second connector frame. These mounting pegs each have a hooked head. The hooked heads snap behind the edges of the respective openings into the second connector frame.

In this construction both the first and second ends of the connecting pins are used together with connector frames to form connectors.

A preferred embodiment of a connector according to the invention is characterized in that along the edge of the openings into the second connector frame at the side facing the circuit board two diametrically opposed projecting, preferable cam shaped ridges are formed. The end faces of the spacer elements directed to the second connector frame each contain semi-circular helically projecting edge sections connected by axial directed edge sections to the second connector. In this embodiment it is possible by turning the spacer elements to adjust the distance between the first and second connector frame.

The adjustment is preferred especially when circuit boards of varying or different thickness are used. Because connecting pins of the same length are used irrespective of the thickness of the circuit board, the distance bridged by the spacer elements will relate to the thickness of said circuit board. By means of the spacer elements, embodied in the above mentioned way, it is possible to adjust the distance between both connector frames.

Preferably the distance is determined by the length of the mounting pegs. If both connector frames are coupled by means of the mounting pegs and the spacer elements are adjusted so, that the hooked heads of the pegs are tightly snapped over the edges of the openings in the second connector frame, than the length of said mounting pegs defines the relative distance between the two connector frames.

BRIEF DESCRIPTION OF THE DRAWINGS

The invention will be explained further in detail referring to the embodiments illustrating in the figures.

FIG. 1 shows a partly sectional view of an electrical connector system according to the invention.

FIG. 3 shows an upperside view of the spacer element used in the electrical connector system according to the invention.

FIGS. 4*a* and 4*b* shows two sectional views of the spacer element during the assembly process of the connector system.

DETAILED DESCRIPTION OF THE INVENTION

Figure 2:
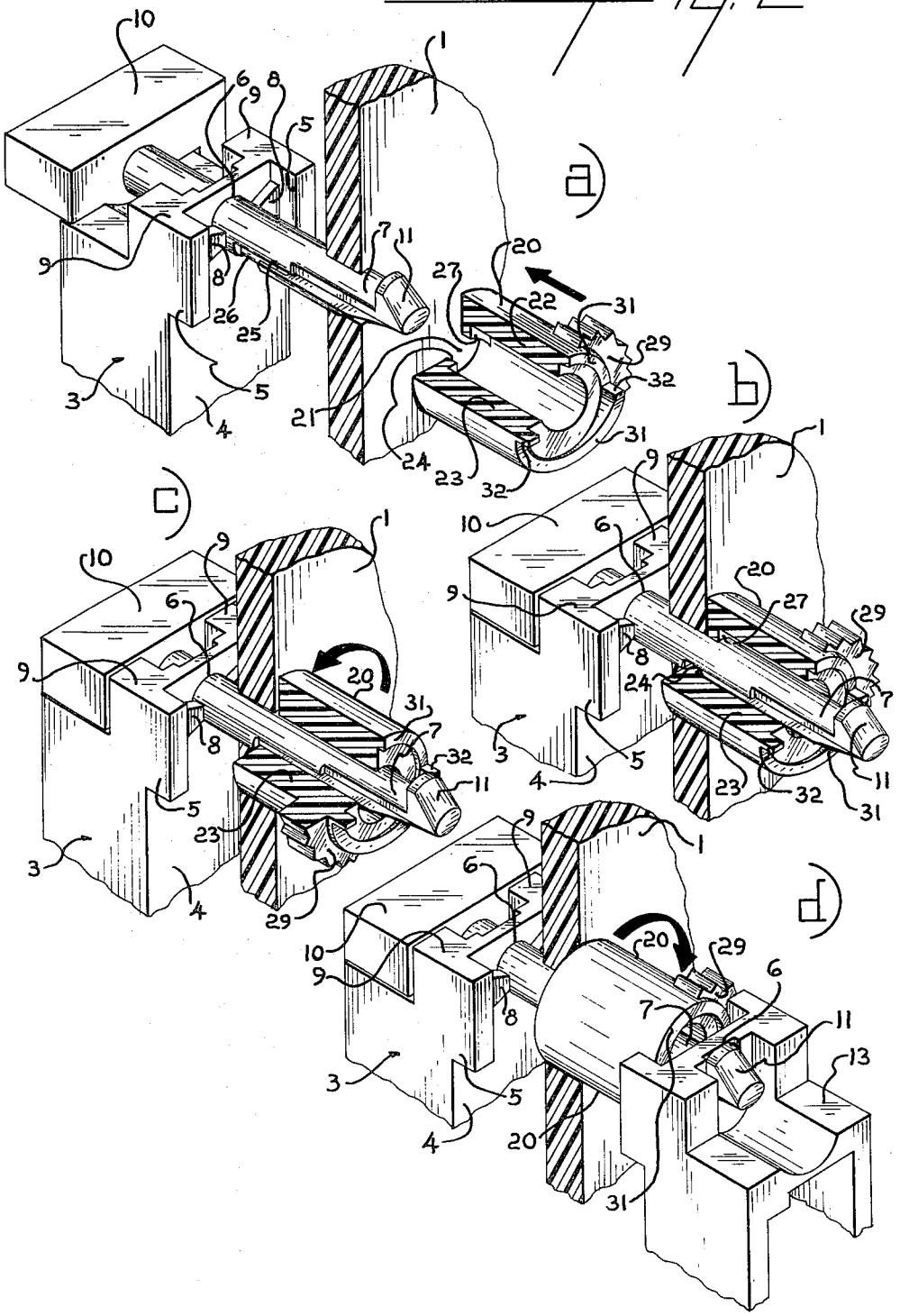
FIGS. 2*a*, 2*b*, 2*c* and 2*d* show in a number of intermediate steps how the electrical connector system according to the invention is assembled.

FIG. 1 shows an electrical connector system according to the invention. The circuit board 1 comprises a number of through holes arranged in a predetermined pattern. The pins are press fit in these holes. Preferably all the pins 2 have the same length. These pins are positioned in the related holes in the circuit board such that all the parts of the pins protruding from one side of the circuit boards have the same length. Then the first connector frame 3 is positioned over the pins at the underside of the circuit board such that the connector frame 3 together with the first part 34 of the pins 2 protrude from the underside of the circuit board to form a male connector. The connector 3 comprises an elongated boxshaped element consisting of a bottom part and four side walls. In the elongated bottom part holes are arranged according to the already mentioned predetermined pattern. The pins 2 are positioned in these holes. The general construction of such a connector is considered known to the expert and therefore will not be explained in detail. A more detailed description is only necessary for both longitudinal end parts of said connector. These parts rest against the circuit board 1. Reference is made to FIG. 2. The bottom part 4 of said connector has protruding ends outside the main boxshaped connector. In the longitudinal direction of said bottom part 4 and protruding in the direction of the circuit board 1 blocks 5 are integrally formed onto the connector body. Between said blocks 5 and the bottom part 4 is an opening 6 having dimensions corresponding to the diameter of the mounting pegs 7 which will be described afterwards. Between each of said blocks 5 and the nearest edge of the opening 6 is a pair of trapezoid shaped protruding parts 8 with preferably a cam shaped supporting face. These parts 8, however, do not protrude as far from the bottom part 4 as both marginal blocks 5. At the other side of the extension from the bottom part 4 are protruding parts 9 functioning as supporting elements for the block 10 formed around the peg 7, which will be explained in detail afterwards.

As illustrated in FIG. 1, a second connector frame 13, shaped in a similar way as the first connector frame 3, is spaced apart from the other side of the circuit board such that the second part 36 of the pins 2 protruding at this side of the circuit board 1 are guided into holes in the bottom part 14 of said connector 13. These holes are arranged in the above mentioned predetermined pattern. In this way the second part 36 of the pins 2 protruding from this side of the circuit board 1 form together with the connector frame 13, a complete male connector.

As is further shown in FIG. 1 the connector frame 13 is spaced apart from the circuit board 1 by means of the spacer elements 20, of which an embodiment will be described in more detail. The mounting of the frame parts 3 and 13 to the circuit board 1 is realized at both ends by means of a peg 7. Peg 7, seen from the underside in FIG. 1, contains a block, which after assembly is supported by the supporting faces of the protruding parts 9. The other end of the peg 7 having a hooked head 11 snaps behind the edge of the opening 6 in the bottom part 38 of the connector frame 13.

As is shown clearly in FIG. 1 the length of the pegs determines the distance between the connector frames 3 and 13. It will furthermore be clear that problems can arise when the circuit board does not have a uniform thickness. When the thickness of the circuit board 1 varies, then the length of the spacer elements 20 also must be adapted to reach a stable construction after assembly. With connectors of this type, furthermore, the distances A and B, pointed out in FIG. 1, are important to obtain a good connection in combination with a suitable female connector. Tolerances for said distances are specified in the so-called DIN-standards.

It will be clear that during positioning of the pins 2 in the circuit board 1 the length of the pin parts 34 protruding from the underside of said circuit board can be chosen such that after positioning of the connector frame 3 onto the circuit board 1 the distance B corresponds to the specified value in said DIN-standards. To maintain the distance A within the specified tolerance limits it is necessary to be able to adjust the distance between the connector frames 3 and 13 accurately irrespective for instance, of thickness variations in the circuit board 1 or other tolerances which can be present in the construction as a whole. For that reason the invention now provides a spacer element of special construction.

As is illustratedin FIGS. 2 and 3 said spacer element comprises a cylindrical shaped body 23. The cylinder has a flat underface but the upper face of said cylinder comprises along the edge nearly over half the circumference helically extending edge segments 31, ending in the of axially directed edge segment 32. The outer diameter of the cylindrical spacer element is smaller than the distance between both block parts 5 protruding from the underside of the connector frames so that the spacer elements fit in between said block segments 5 and the helically extended edge segments can cooperate with the protruding parts 8. Without explicitly describing further details of said spacer element it will be clear that by turning said spacer elements 20 the distance between the connector frame 13 and the circuit board 1 can be varied because of the cooperation between the protruding, preferably cam shaped parts 8 at the underside of the connector frame 13 and the helically extending edge segments 31 at the upper face of the spacer elements 20. The adjustment can be used to control the distance between the connector frame 13 and the circuit board 1 after assembling the various parts such that the hooked heads 11 and the upper ends of the pegs 7 are tightly snapped over the related edges of the openings 6 in the connector frame 13. Because the length of said mounting pegs 7 determines the mutual distance between the connector frame 13 and the connector frame 3 the result of turning the spacer elements is that possible variations in the thickness of the circuit board 1 are eliminated and therefore the distance between the two connector frames is indeed determined by the length of pegs 7.

In such a construction a further problem may arise. By turning the spacer elements 20 to adjust the distance between the connector frame 13 and the circuit board 1, and the distance between the connector frame 13 and the connector frame 3, tensions may develop especially in the hooked heads 11 and the pegs 7. If, for instance, the spacer element 20 is turned too tightly, or if the connector 13 is loaded too heavily, the tension may become too high. In this circumstance the upper parts of the pegs 7, especially the hooked head 11 will move inwardly (by deformation) under the influence of said tension to such an extent that the connections formed by said hooked heads 11 and the edges of the related openings 6 in the connector frame 13 may be broken. In this situation the connector frame 13 may come loose.

A further embodiment of the spacer element according to this invention gives a solution for this problem. Special reference is made to FIGS. 2 and 3, the latter showing an upper side view of the spacer element 20. As shown in the figures the spacer element 20 has a central circular opening 21 extending from the underside. Said centrally positioned circular opening 21 passes into an eccentrically positioned opening 22 extending from the upperside of the spacer element to the underside thereof. As shown in FIG. 3 the openings 21 and 22 have a common wall part 28, which in the illustrated embodiment extends over nearly half the outline of the opening 21. The remaining nonaligned wall parts define a sickle shaped transitional edge 27 near the underside of the spacer element.

The ledge pin 24 positioned in the circular opening at the inside of the spacer element operates with a key-way 25, extending in axial direction into the peg 7. As shown in FIG. 2 *a* the spacer element 20 can only be shifted over the peg 7 in one position because of said ledge pin 24. The axial key-way 25 cooperating with the ledge pin 24 during the shifting movement of the spacer element ends in a radial ledge groove 26 extending over half the circumference of the peg 7. As soon as the ledge pin 24 reaches said radial ledge groove 26 and the spacer element 20 turns over a short distance then said ledge pin 24 will move in said ledge groove 26 so that the spacer element 20 cannot be pulled from the peg 7.

During assembly of the connector system according to the invention, the pegs 7 are guided through the openings 6 in the connector frame 3 and are thereafter guided through the related openings in the circuit board 1. Then, as is shown for one end of a connector frame in FIG. 2, the spacer elements 20 are shifted onto the pegs 7 at the other side of the circuit board such that the ledge pin 24 through the key-way 25 is positioned at the beginning of the ledge groove 26. Then the situation illustrated in FIG. 2*b* is reached. Thereafter the spacer element 20 will be turned over about 180° (counterclockwise seen in FIG. 2*c*), such that the ledge pin 24 is guided through the ledge groove 26 until it reaches the other end of said groove which is not visible in the figures. The connector frame 3 is now secured against loosening. The other end of the connector frame 3 which is not illustrated in FIG. 2 will be secured similarly.

The FIGS. 4*a* and 4*b* show two partial sectional views according to the same plane as the sectional view in FIG. 1. These views especially relate to the left peg 7, and corresponding spacer element 20 in FIG. 1. As soon as the spacer element is shifted over the peg 7 so that the situation from FIG. 2*b* is reached, then the peg 7 and the spacer element 20 are mutually positioned as illustrated in FIG. 4*b*. The connector frame part 13, is not shown in FIG. 2*b*. The sickle shaped edge is situated at the left side in FIG. 4*b* and the right side of peg 7 is completely resting against the aligned wall part 28 of the bores 21 and 22. Now the spacer element is turned over about 180°, so that the situation illustrated in FIG. 2*c* is reached, corresponding with the partial sectional view in FIG. 4*a*. Now the left part of peg 7 is completely resting against the aligned wall part 28 over the bores 22 and 21. In this situation it is possible to bend (deform) the hooked head of the peg 7 over a little distance to the right so that it is possible to place the connector frame 13 onto the pegs 7. Under minimum pressure the hooked heads 11 bend rearwardly so that the pegs 7 are guided through the openings 6 in the connector frame 13 after which the hooked heads 11 return elastically and snap over the edges of the openings 6 to realize the snap connection illustrated in FIG. 1.

After the connector frame 13 is positioned in this way the spacer elements are again turned but now in the clockwise direction as seen in FIG. 2*d* so that, as already mentioned, possible uneven tolerances are eliminated and the connector frames 3 and 13 are fixed at the right intermediate distance. Because of the eccentricity of the bores 21 and 22 in the spacer element and because of the special shape of the bore 22, illustrated in FIG. 3, a short turning of the spacer element 20 causes a situation to be reached in which the right side of peg 7 in FIG. 4*b* is completely resting against the aligned wall part of the openings 21 and 22. In this situation the hooked head 11 of the peg 7 cannot be moved to the right or at least not be moved far away to the right to loosen the hooked head 11 from the edge of the opening 6, so that even if greater tensions are developed in the construction, the mechanical connection is unbreakably maintained.

As illustrated in the figures the spacer element 20 contains a protruding milled edge grip element 29 to facilitate the turning of the spacer element. It will be clear that also other edges can be used for facilitating the turning movement. It is, for instance, possible to use a hexagonal protruding edge functioning like a gripping edge for a tool.

In a further embodiment of the invention, which is not illustrated in detail in the figures, the connector frame 3 is positioned at a certain distance from the circuit plate 1. Between the connector frame 3 and the circuit board 1 conventional cylindrical spacer elements are used having a predetermined length. When the pins 2 are positioned in the circuit board 1 attention has to be paid so that the parts of the pins protruding from the side directed towards the connector frame 3 have a predetermined length irrespective of the thickness of the circuit board 1. The other connector frame 13 is thereafter positioned by means of the correspondingly longer pins and adjusted by means of the above described spacer elements 20.

Although the above mentioned description is based on a construction in which first of all the connecting pins 2 are pressed through openings in the circuit board 1 after which the connector frame 3 is positioned it is of course possible to start with a complete connector having connecting pins, which connecting pins are guided through the holes in the circuit board 1.

Although the above mentioned description is based on connecting pins protruding over the same distance from one side of the circuit board it is possible to let a predetermined number of pins protrude over a longer distance. In that case a male connector is realized. When a female connector is positioned onto said male the first contact is made by said further protruding pins. This is for instance preferable when the connectors are used for connecting MOS-circuits. The further protruding and therefor first contacting connecting pins could be connected to ground potential so that the MOS-circuits which are to be connected first are grounded. Through the other pins further voltages are supplied to said MOS-circuit.

It is furthermore remarked that the first and second connector frame can be shaped identically.

The invention provides an electrical connector system with two connector frames mutually mounted at a predetermined distance irrespective of possible tolerance differences in the circuit board positioned in between. The mounting means functions not only for the distance adjustment but also for realizing a connection which can withstand possibly high part stresses.

Although the invention is described referring to a preferred embodiment thereof it will be clear that several variations are possible in the scope of the invention. It is for instance possible to eliminate the protruding parts 9, defining the supporting faces for the block 10 at the end of peg 7. Also for instance block 10 may have a completely different shape.

I claim:

1. In an electrical connector apparatus having first and second connectors, each containing multiple pin receiving channels, one connector on each side of and spaced apart from a circuit board containing pin receiving channels, said connectors and circuit board all electrically connected by a multiplicity of connector pins passing through the pin receiving channels in the connectors and the circuit board, a pair of mounting pegs supporting said first and second connectors and extending through openings in said connectors and circuit board, the improvement comprising positioning a cylindrically shaped spacer element on each mounting peg between said circuit board and the second connector which is movable with respect to said circuit board, said spacer element having two ends, one facing the second connector and the other facing the circuit board, the spacer having a helically extending edge over about half the circumference of the end facing the second connector, said edge cooperating with cam like projections on the second connector to provide movement between the second connector and said circuit board in response to rotation of said spacer element.

2. Electrical connector apparatus according to claim 1 wherein the mounting pegs have a key-way extending axially from an upper face and ending in a radial ledge groove extending over half the circumference of the mounting peg and the spacer element has a ledge pin positioned in a central bore and cooperating with the key-way.

3. Electrical connector apparatus according to claim 1 wherein the mounting pegs are fixed with respect to the first connector and movable with respect to the second connector.

* * * * *